US010947870B2

(12) United States Patent
Kandolf et al.

(10) Patent No.: US 10,947,870 B2
(45) Date of Patent: Mar. 16, 2021

(54) COUPLING FOR A CAMSHAFT PHASER ARRANGEMENT FOR A CONCENTRIC CAMSHAFT ASSEMBLY

(71) Applicant: Schaeffler Technologies AG & Co. KG, Herzogenaurach (DE)

(72) Inventors: Michael Kandolf, Saint Clair, MI (US); Andrew Mlinaric, Lakeshore (CA); Steven Burke, Fort Gratiot, MI (US); Nathanael Biester, Rochester, MI (US); Vaishnavi Pawade, Rochester Hills (IN)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 4 days.

(21) Appl. No.: 16/403,832

(22) Filed: May 6, 2019

(65) Prior Publication Data

US 2019/0360364 A1 Nov. 28, 2019

Related U.S. Application Data

(60) Provisional application No. 62/676,709, filed on May 25, 2018.

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34426* (2013.01); *F01L 2001/34489* (2013.01)

(58) Field of Classification Search
CPC . F01L 1/344; F01L 1/3442; F01L 1/34; F01L 1/047; F01L 1/34413; F01L 1/026; F01L 1/022; F01L 2001/34426; F01L 2001/34489; F01L 2001/0473; F01L 2001/0535; F01L 2001/0537; F01L 2001/3521; F01L 2001/34496; F01L 9/04; F01L 2820/041; F01L 2820/032; F16H 53/04; F16H 57/0037; F16H 2059/0295; F16D 3/04; F16D 3/06; F16D 3/14; F16D 3/18

(Continued)

(56) References Cited

U.S. PATENT DOCUMENTS 6,725,817 B2 4/2004 Methley et al.
7,841,311 B2 11/2010 Hutcheson et al.
(Continued)

FOREIGN PATENT DOCUMENTS

DE 102009041755 A1 4/2010
DE 102015207104 A1 * 10/2016 ..... F01L 1/3442
EP 3141711 A1 * 3/2017 ..... F01L 1/344

*Primary Examiner* — Zelalem Eshete
(74) *Attorney, Agent, or Firm* — Matthew Evans

(57) ABSTRACT

A camshaft phaser arrangement configured for a concentric camshaft assembly having inner and outer camshafts is provided. The camshaft phaser arrangement includes a first camshaft phaser, a second camshaft phaser, and a coupling that non-rotatably connects the first camshaft phaser to the concentric camshaft assembly. Each of the camshaft phasers is configured to be connected to either the inner or the outer camshaft. The coupling accommodates for radial and axial offset between the first camshaft phaser and the second camshaft phaser.

20 Claims, 7 Drawing Sheets

(58) Field of Classification Search
USPC ..... 123/90.17, 90.15; 464/102, 104
See application file for complete search history.

(56) References Cited

U.S. PATENT DOCUMENTS

| | | | | |
|---|---|---|---|---|
| 8,051,818 | B2 | 11/2011 | Myers et al. | |
| 8,371,257 | B2 * | 2/2013 | Moon | F01L 1/3442 123/90.15 |
| 8,736,120 | B2 * | 5/2014 | Maeda | F16D 3/04 310/75 D |
| 9,080,474 | B2 | 7/2015 | Wigsten et al. | |
| 2005/0257764 | A1 * | 11/2005 | Lehmann | F01L 1/3442 123/90.17 |
| 2006/0105844 | A1 * | 5/2006 | Sweet | F16D 3/76 464/102 |
| 2006/0207538 | A1 * | 9/2006 | Lancefield | F01L 1/3442 123/90.17 |
| 2009/0038568 | A1 * | 2/2009 | Kira | F01L 1/022 123/90.17 |
| 2010/0089353 | A1 | 4/2010 | Myers et al. | |
| 2010/0093453 | A1 * | 4/2010 | Myers | F01L 1/3442 464/160 |
| 2010/0186698 | A1 | 7/2010 | Pluta | |
| 2017/0107867 | A1 * | 4/2017 | Flender | F01L 1/047 |
| 2017/0260884 | A1 * | 9/2017 | Nance | F01L 1/047 |
| 2018/0274400 | A1 | 9/2018 | Berwinkl et al. | |
| 2019/0331170 | A1 * | 10/2019 | Tsujimoto | F16D 3/04 |

* cited by examiner

COUPLING FOR A CAMSHAFT PHASER ARRANGEMENT FOR A CONCENTRIC CAMSHAFT ASSEMBLY

CROSS-REFERENCE TO RELATED APPLICATIONS

This application claims the benefit of U.S. Provisional Patent Application No. 62/676,709 filed May 25, 2018, the disclosure of which is incorporated in its entirety by reference herein.

TECHNICAL FIELD

Example aspects described herein relate to couplings for camshaft phasers, and, more particularly, to camshaft phasers utilized within an internal combustion (IC) engine having a concentric camshaft assembly.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator to achieve variable engine valve timing. Electric camshaft phasers can be configured with a gearbox and an electric motor to phase a camshaft to achieve variable engine valve timing.

Many different camshaft configurations are possible within an IC engine. Some camshaft configurations include an intake camshaft that only actuates intake valves, and an exhaust camshaft that only actuates exhaust valves; such camshaft configurations can often simplify efforts to independently phase the intake valve events separately from the exhaust valve events. Other camshaft configurations can utilize a single camshaft to actuate both intake and exhaust valves; however, a single camshaft configured with both intake and exhaust lobes proves difficult to provide independent phasing of the intake and exhaust valves. For single camshaft configurations, a concentric camshaft assembly can be implemented that utilizes an inner camshaft and an outer camshaft, each arranged with one of either exhaust lobes or intake lobes, with each of the camshafts having a designated camshaft phaser to vary the respective engine valve timing.

One known camshaft phaser arrangement for a concentric camshaft assembly includes a first and a second camshaft phaser that are stacked coaxially at an end of the concentric camshaft assembly. A solution is needed that facilitates connection of this camshaft phaser arrangement to the concentric camshaft assembly while torsionally or rotationally coupling the two camshaft phasers to a crankshaft of the IC engine.

SUMMARY

A camshaft phaser arrangement configured for a concentric camshaft assembly having inner and outer camshafts is provided. The camshaft phaser arrangement includes a first camshaft phaser, a second camshaft phaser, and a coupling. The first camshaft phaser is configured to be connected to one of the inner or the outer camshafts. The second camshaft phaser is configured to be connected to the other of the inner or outer camshafts. The coupling has a first end non-rotatably connected to a coupling end of a center hub of the first camshaft phaser and a second end configured to be non-rotatably connected to the one of the inner or outer camshafts. The coupling is configured to accommodate at least one of a radial offset or an axial offset between the first and second camshaft phasers; or, alternatively stated, the coupling is configured to accommodate at least one of a radial offset or an axial offset between first camshaft phaser and the concentric camshaft assembly. At least one first fastener connects the first camshaft phaser to the second camshaft phaser. The at least one first fastener can connect a first stator of the first camshaft phaser to a second stator of the second camshaft phaser. In an example embodiment, the at least one first fastener connects the first stator to a second outer cover of the second camshaft phaser, the second outer cover non-rotatably connected with the second stator. At least one support boss can extend axially from the second outer cover to receive the at least one first fastener.

The coupling can be configured to accommodate a first radial offset and a second radial offset between the first camshaft phaser and the second camshaft phaser, or between the first camshaft phaser and the concentric camshaft assembly. The first radial offset can be perpendicular to the second radial offset.

The coupling can include a through-aperture that is configured to fluidly connect the concentric camshaft assembly to the first camshaft phaser. In an example embodiment, the coupling fluidly connects the inner camshaft to the center hub of the first camshaft phaser, supplying hydraulic fluid to a hydraulic fluid control valve.

The camshaft phaser arrangement can also include: a first compliant radial seal that is arranged to seal the center hub to the first end of the coupling; and, a second compliant radial seal that is arranged to seal the second end of the coupling to the one of the inner or outer camshafts. The first compliant radial seal can be configured to maintain engagement with both the center hub and the coupling while the coupling accommodates the at least one of a radial offset or an axial offset between the first camshaft phaser and the second camshaft phaser; or, alternatively stated, at least one of a radial offset or an axial offset between the first camshaft phaser and the concentric camshaft assembly. The second compliant radial seal can be configured to maintain engagement with both the coupling and the one of the inner or outer camshafts while the coupling accommodates the at least one of a radial offset or an axial offset.

The first end of the coupling and the coupling end of the center hub can cooperate to form a first rotational poka-yoke, and the second end of the coupling can be configured to form a second rotational poka-yoke with the one of the inner or outer camshaft.

The first end of the coupling can include at least one hub tab that is configured to be received by the center hub. The at least one hub tab and the center hub can define a pathway for at least one of a first radial offset or a first axial offset. The second end of the coupling can include at least one camshaft tab that is configured to be received by the one of the inner or outer camshafts. The at least one camshaft tab and the one of the inner or outer camshafts can define a pathway for at least one of a second radial offset or a second axial offset.

In an example embodiment, the at least one hub tab comprises a first tab and a second tab, and the at least one camshaft tab comprises a third tab and a fourth tab. The first tab can have a first width that is different than a second width of the second tab, and the third tab can have a third width that is different than a fourth width of the fourth tab. A center of the first tab can be located within a range of 175 to 185 degrees from a center of the second tab, and a center of the third tab can be located within a range of 175 to 185 degrees from a center of the fourth tab. A first line that connects the center of the first tab to the center of the second tab can be perpendicular to a second line that connects the center of the third tab to the center of the fourth tab.

The coupling end of the center hub and the first end of the coupling can cooperate to accommodate at least one of: (i) a first axial offset between the first camshaft phaser and the concentric camshaft assembly; or, (ii) a first radial offset between the first camshaft phaser and the concentric camshaft assembly. The second end of the coupling can be configured to cooperate with the one of the inner or outer camshafts to accommodate at least one of: (i) a second axial offset between the first camshaft phaser and the concentric camshaft assembly; or, (ii) a second radial offset between the first camshaft phaser and the concentric camshaft assembly. The first radial offset can be perpendicular to the second radial offset.

The camshaft phaser arrangement can also include a hydraulic fluid control valve that is arranged within the first camshaft phaser, with the first camshaft phaser arranged axially outward of the second camshaft phaser. In an example embodiment, the center hub is configured to be attached to the first camshaft phaser via a threaded interface with the hydraulic fluid control valve.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
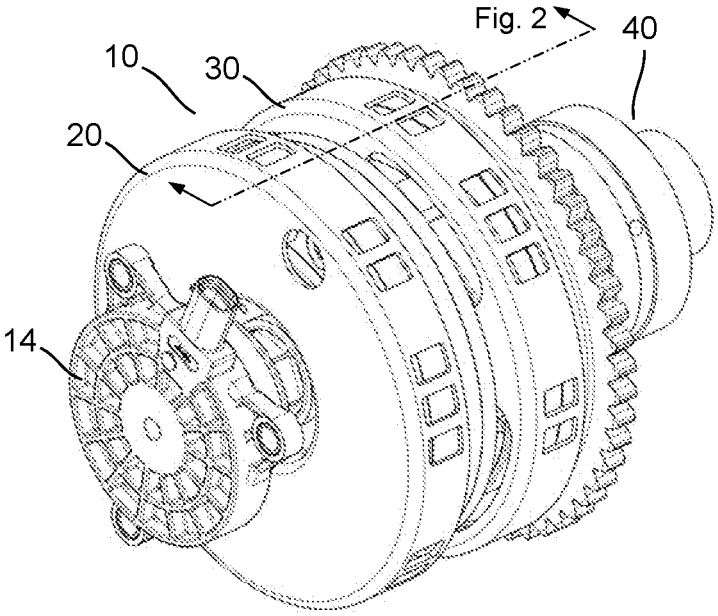
FIG. 1 is a perspective view of a camshaft phaser arrangement for a concentric camshaft assembly shown together with a first hydraulic fluid control valve. The camshaft phaser arrangement includes a first camshaft phaser and a second camshaft phaser.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

The term "non-rotatably connected" can be used to help describe various connections of camshaft phaser components and is meant to signify two elements that are directly or indirectly connected in a way that whenever one of the elements rotate, both of the elements rotate in unison, such that relative rotation between these elements is not possible. Radial and/or axial movement or offset of non-rotatably connected elements with respect to each other is possible, but not required.

Figure 2:
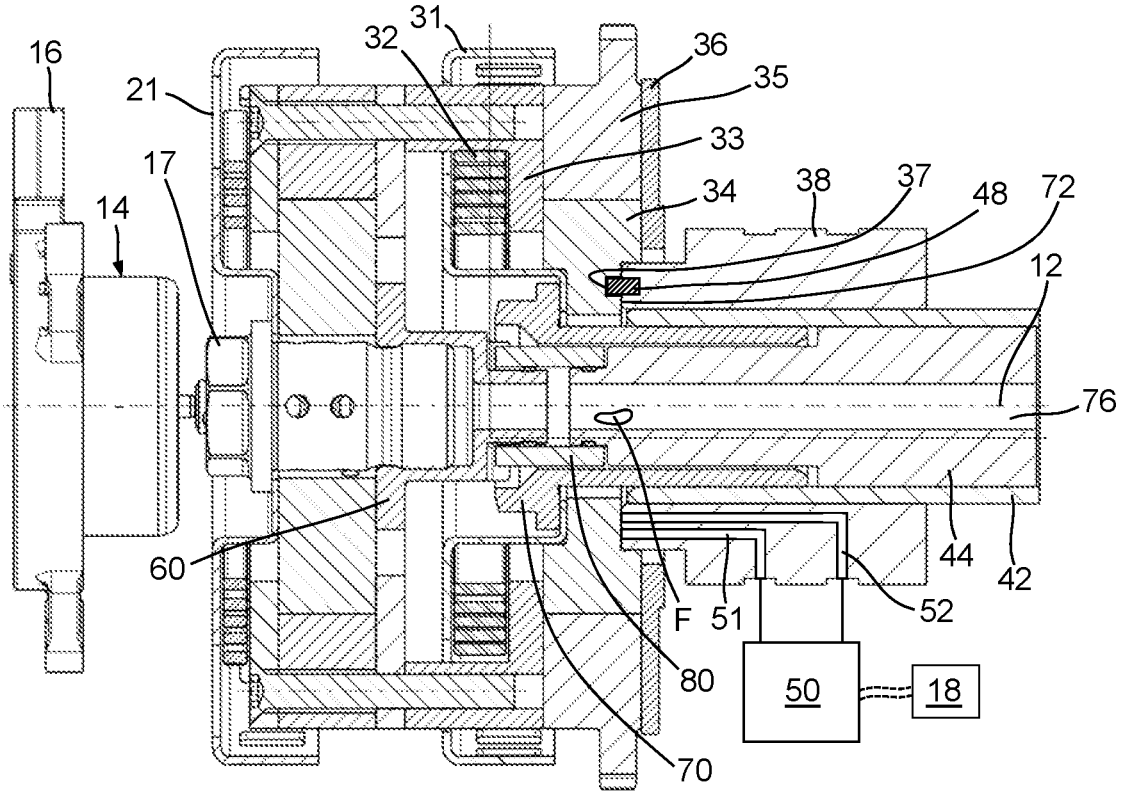
FIG. 2 is a cross-sectional view taken from FIG. 1 together with a second hydraulic fluid control valve.
Figure 3:
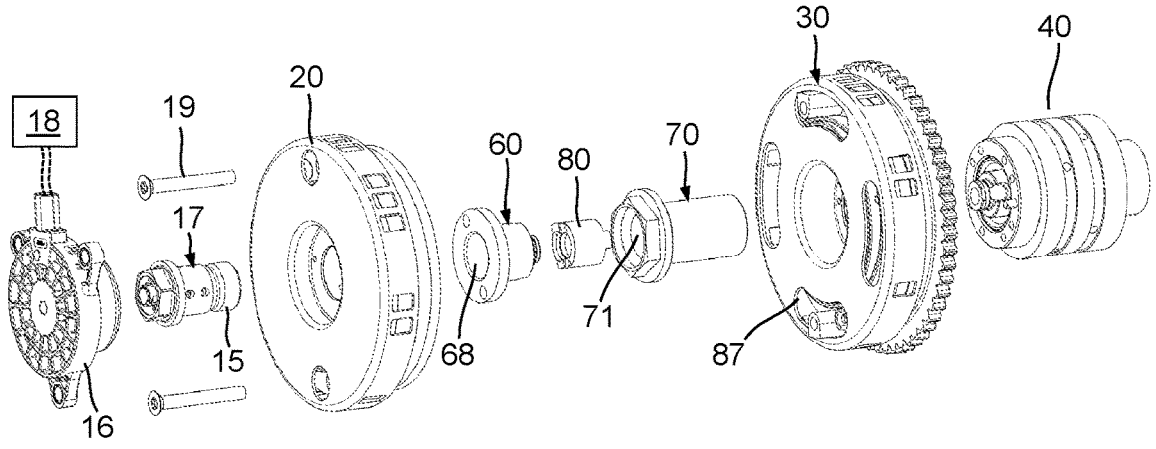
FIG. 3 is an exploded perspective view of the camshaft phaser arrangement of FIG. 1 showing a coupling that non-rotatably connects the first camshaft phaser to the concentric camshaft assembly.
Figure 4:
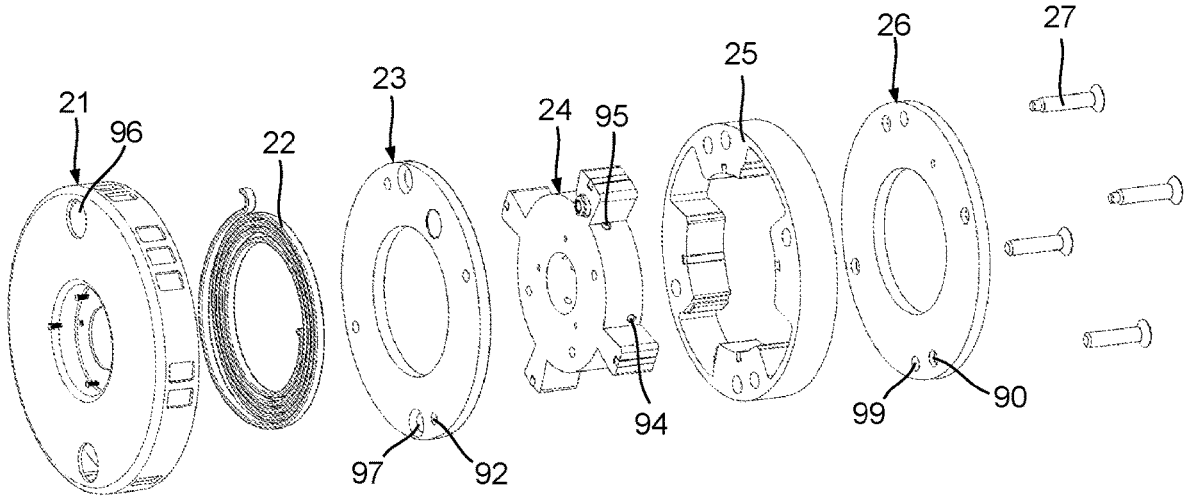
FIG. 4 is an exploded perspective view of the first camshaft phaser of FIG. 1 that includes a first stator, a first rotor, a first outer cover, a first inner cover, and a first bias spring.
Figure 5:
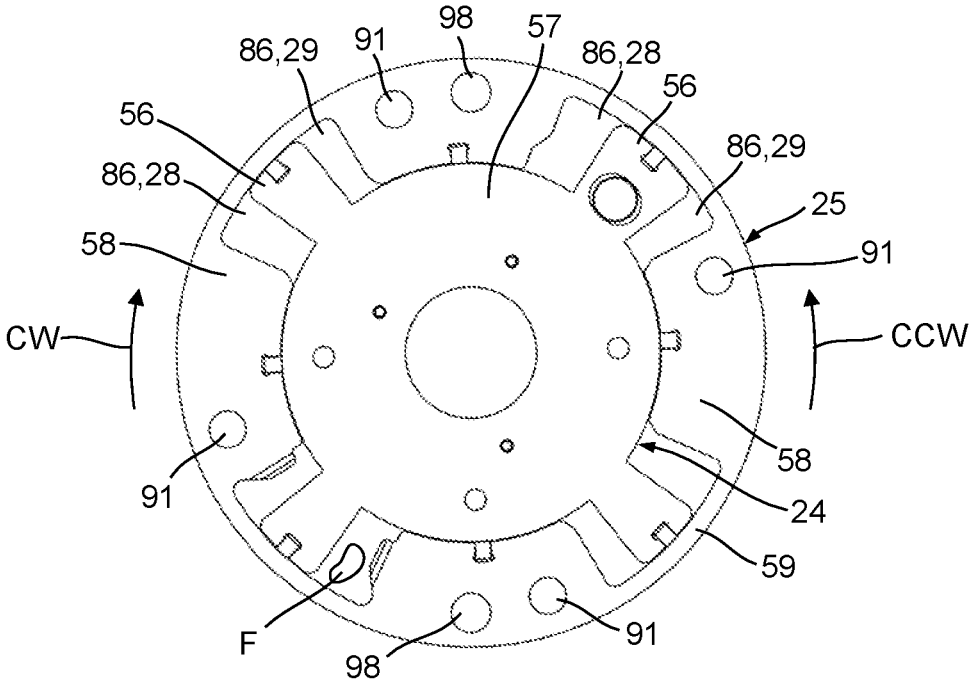
FIG. 5 is a front view of an assembly of the first stator and the first rotor of FIG. 4.
Figure 6:
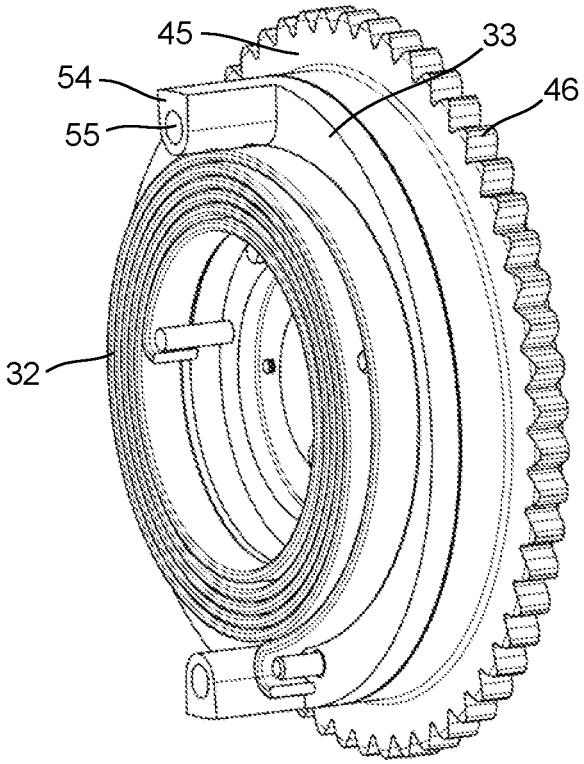
FIG. 6 is a perspective view of the second camshaft phaser of FIG. 1 with a second timing wheel removed.
Figure 7A:
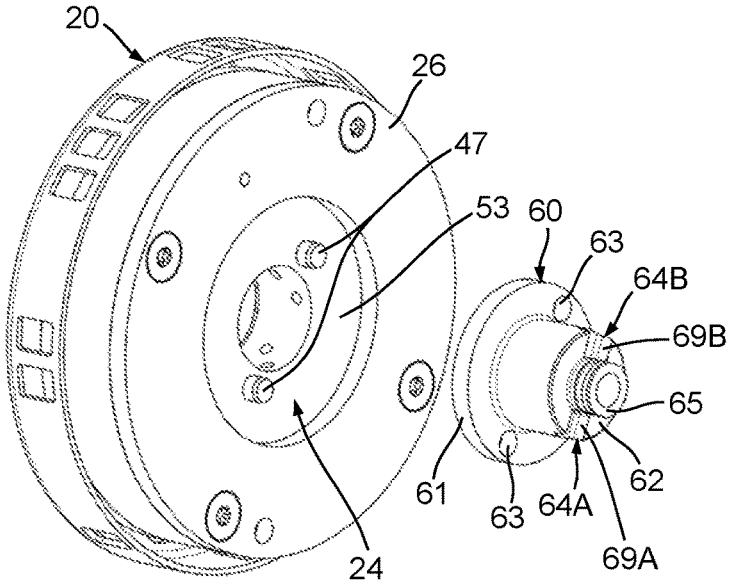
FIG. 7A is a perspective view of the first camshaft phaser of FIG. 1 together with a center hub.
Figure 7B:
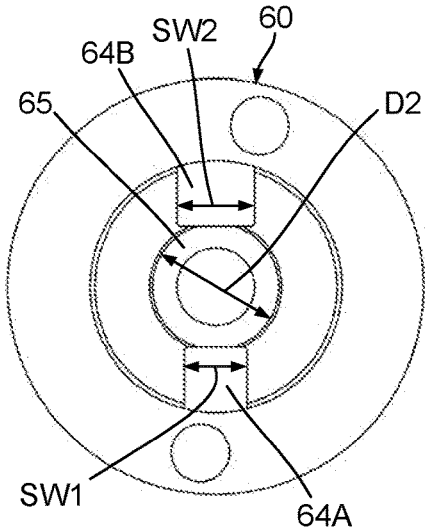
FIG. 7B is a front view of the center hub of FIG. 7A.
Figure 8:
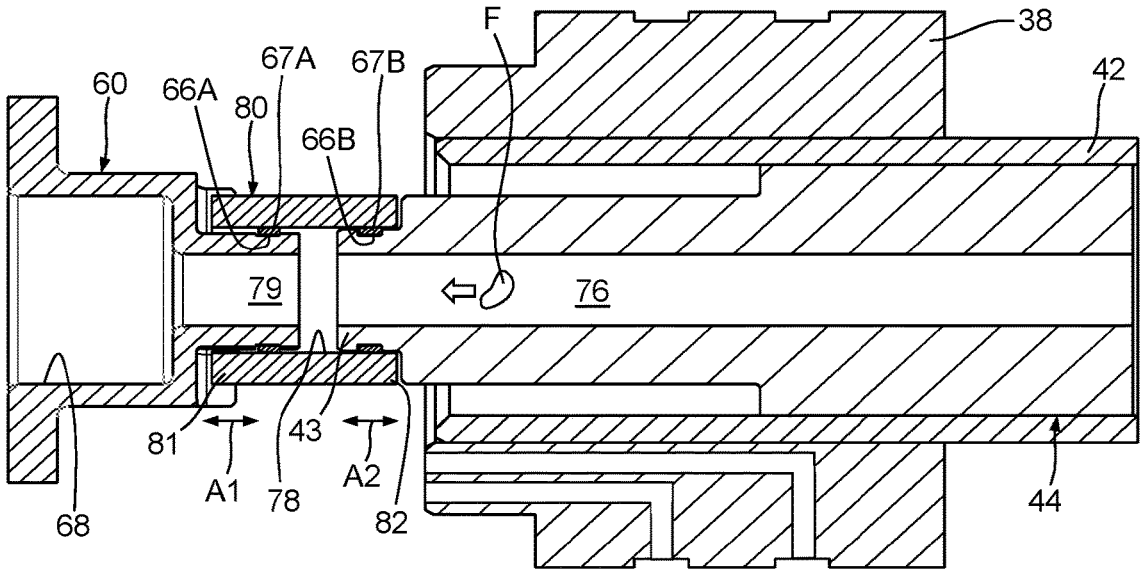
FIG. 8 is an enlarged portion of the cross-sectional view of FIG. 2.

Referring to FIG. 1, a perspective view of an example embodiment of a camshaft phaser arrangement 10 for a concentric camshaft assembly 40 is shown together with a first hydraulic fluid control valve 14. The camshaft phaser arrangement 10 includes a first camshaft phaser 20 and a second camshaft phaser 30. FIG. 2 shows a cross-sectional view taken from FIG. 1 together with a second hydraulic fluid control valve 50. FIG. 3 shows an exploded perspective view of the camshaft phaser arrangement 10 of FIG. 1 that shows a coupling 80 that non-rotatably connects the first camshaft phaser 20 to the concentric camshaft assembly 40. FIG. 4 shows an exploded perspective view of the first camshaft phaser 20. FIG. 5 shows a front view of an assembly of a first rotor 24 and a first stator 25 of the first camshaft phaser 20. FIG. 6 shows a perspective view of the second camshaft phaser 30 without a second timing wheel 31 for improved clarity. FIG. 7A shows a perspective view of the first camshaft phaser 20 together with a center hub 60. FIG. 7B shows a front view of the center hub 60. FIG. 8 shows an enlarged portion of the cross-sectional view of FIG. 2. FIGS. 9A through 9D show various views of the coupling 80. FIG. 10A shows a perspective view of the concentric camshaft assembly 40, while FIG. 10B shows a front view of the concentric camshaft assembly 40. The following discussion should be read in light of FIGS. 1 through 10B.

The camshaft phaser arrangement 10 includes a rotational axis 12, the first camshaft phaser 20, the second camshaft phaser 30, the center hub 60, and the coupling 80 that non-rotatably connects the first camshaft phaser 20 to the concentric camshaft assembly 40. The first camshaft phaser 20 is arranged axially adjacent to the second camshaft phaser 30 such that the first camshaft phaser 20 is axially outward of the second camshaft phaser 30. Additionally, the first camshaft phaser 20 can be concentric with the second camshaft phaser 30, as shown. The concentric camshaft assembly 40 includes an outer camshaft 42 and an inner camshaft 44. The first camshaft phaser 20 and the second camshaft phaser 30 of FIG. 1 are hydraulically actuated; however, one of the first or second camshaft phasers 20, 30 could be an electric camshaft phaser.

Referring specifically to FIGS. 4 and 5, hydraulic actuation of the first and second camshaft phasers 20, 30 will be described with specific reference to the first camshaft phaser 20 and its respective components. The first camshaft phaser 20 includes a first timing wheel 21, a first bias spring 22, a first outer cover 23, a first rotor 24, a first stator, 25 and a first inner cover 26. The first rotor 24 includes vanes 56 that extend radially outward from a central portion 57 of the first rotor 24. The first stator 25 includes protrusions 58 that extend radially inward from an outer ring portion 59 of the first stator 25. A plurality of phaser fasteners 27 extend through inner cover apertures 90 of the first inner cover 26, through clearance apertures 91 of the first stator 25, and attach to outer cover attachment apertures 92 of the first outer cover 23. The first inner cover 26 and the first outer cover 23, together with the vanes 56 of the first rotor 24 and the protrusions 58 of the first stator 25, form hydraulic actuation chambers 86 within the first camshaft phaser 20. The first camshaft phaser 20 is hydraulically actuated by pressurized hydraulic fluid F that is managed by the first hydraulic fluid control valve 14 to move the first rotor 24 either in a clockwise CW or a counterclockwise CCW direction relative to the first stator 25. The first hydraulic fluid control valve 14 includes an electromagnet 16, controlled by an electronic controller 18, that interfaces with a valve body 17 to manage a flow of hydraulic fluid F to actuate the first rotor 24. The first rotor 24 is non-rotatably connected to an inner camshaft 44 of the concentric camshaft assembly 40 by the coupling 80, therefore, clockwise CW and counterclockwise CCW movements of the first rotor 24 relative to the first stator 25 can advance or retard an engine valve event with respect to a four-stroke cycle of an IC engine. Clockwise CW rotation of the first rotor 24 relative to the first stator 25 can be achieved by: 1). pressurization of first chambers 28 via first hydraulic fluid ports 94; and, 2). de-pressurization of second chambers 29 via second hydraulic fluid ports 95. Likewise, counterclockwise CCW rotation of the first rotor 24 relative to the first stator 25 can be achieved by: 1). pressurization of the second chambers 29 via the second hydraulic fluid ports 95; and, 2). de-pressurization of the first chambers 28 via the first hydraulic fluid ports 94. The preceding pressurization and de-pressurization actions of the first and second hydraulic fluid ports 94, 95 can be accomplished by the first hydraulic fluid control valve 14. The first hydraulic fluid control valve 14 can communicate electronically with an electronic controller 18 to control the first camshaft phaser 20.

The second camshaft phaser 30 includes a second timing wheel 31, a second bias spring 32, a second outer cover 33, a second rotor 34, a second stator 35, and a second inner cover 36. The second camshaft phaser 30 can be assembled with fasteners (not shown) like that of the first camshaft phaser 20, which non-rotatably connect the second outer cover 33 and the second inner cover 36 to the second stator 35 while permitting rotation of the second rotor 34 relative the second stator 35. The second stator 35 of the second camshaft phaser 30 is non-rotatably connected to a drive wheel 45 with a power transmission interface 46. The power transmission interface 46 can engage with an endless drive band 13 (FIG. 11A) such as a belt or chain; or, with a gear, or any other suitable interface that rotationally connects the second camshaft phaser 30 to a crankshaft 85 (FIG. 11A) or any other power source within an IC engine. Actuation of the second camshaft phaser 30 occurs hydraulically, as previously described for the first camshaft phaser 20. The second hydraulic fluid control valve 50, arranged remotely from the camshaft phaser arrangement 10 and controlled by the electronic controller 18, manages rotation or phasing of the second rotor 34 relative to the second stator 35 via first and second fluid galleries 51, 52 that are fluidly connected to the second rotor 34.

The second stator 35 of the second camshaft phaser 30 is non-rotatably connected to the first stator 25 of the first camshaft phaser 20 by the first fasteners 19. This connection is aided by first target wheel clearance holes 96 that allow tool access to the first fasteners 19, and further facilitated by outer cover clearance holes 97, stator clearance holes 98, inner cover clearance holes 99, second target wheel circumferential slotted holes 87, and support boss holes 55 that are configured within support bosses 54 that extend axially from the second outer cover 33.

Attachment of the camshaft phaser arrangement 10 to the concentric camshaft assembly 40 will now be described. The second camshaft phaser 30 is non-rotatably connected to the outer camshaft 42 by a cam bolt 70 that attaches to an inner diameter of the outer camshaft 42, via threaded interface or other suitable means. More specifically, the cam bolt 70 axially clamps the second timing wheel 31 and the second rotor 34 of the second camshaft phaser 30 to a journal bearing 38 that is non-rotatably connected to the outer camshaft 42. To ensure proper timing of the second rotor 34 to the outer camshaft 42, a reception cavity 37 is arranged on a second axial face 72 of the second rotor 34 to receive a timing pin 48 that protrudes from a first axial face 39 of the journal bearing 38. Other timing arrangements between the second rotor 34 and the outer camshaft 42 are also possible.

The cam bolt 70 has a longitudinal through-aperture 71 through which the inner camshaft 44 extends to facilitate the non-rotatable connection with the first camshaft phaser 20. This connection will be described with view to FIGS. 7A through 10B, in addition to the previously referenced Figures. The first rotor 24 of the first camshaft phaser 20 includes a center hub 60 that can be integrated within the first rotor 24 or formed as a separate component. In an example embodiment shown in the Figures, the center hub 60 is a separate component that connects to the first rotor 24. With view to FIG. 7A, a phaser end 61 of the center hub 60 includes receiving apertures 63 for timing pins 47 that protrude from a first rotor face 53 of the first rotor 24. The center hub 60 can be secured to the first rotor face 53 by a threaded connection that includes a threaded end portion 15 of the valve body 17 of the first hydraulic fluid control valve 14 and a threaded inner diameter 68 of the center hub 60 to which the valve body 17 connects (FIG. 3). In an example embodiment, the timing pins 47 could also extend from the phaser end 61 of the center hub 60 and be received by receiving apertures arranged in the first rotor face 53.

The coupling 80 non-rotatably connects a coupling end 62 of the center hub 60 to a drive end 43 of the inner camshaft 44, while facilitating a flow of hydraulic fluid F from the inner camshaft 44 to the valve body 17 of the first hydraulic fluid control valve 14.

A first end 81 of the coupling 80 is non-rotatably connected to the coupling end 62 of the center hub 60, accommodating a first radial offset R1 and a first axial offset A1. The first end 81 of the coupling includes a first hub tab 83A and a second hub tab 83B that are received by a respective first slot 64A and a second slot 64B arranged at the coupling end 62 of the center hub 60. The first and second hub tabs 83A, 83B and the first and second slots 64A, 64B define a pathway for the first radial offset R1 and a pathway for the first axial offset A1. The first hub tab 83A has a first hub tab perimeter surface 89A and the second hub tab 83B has a second hub tab perimeter surface 89B; the first slot 64A has a first slot perimeter surface 69A and the second slot 64B has a second slot perimeter surface 69B. Therefore, it could be stated that the first and second hub tab perimeter surfaces 89A, 89B together with the respective first and second slot perimeter surfaces 69A, 69B define a pathway for the first radial offset R1 and a pathway for the first axial offset A1. The first and second hub tabs 83A, 83B and the respective first and second slots 64A, 64B provide a non-rotatable connection between the coupling 80 and the center hub 60, while accommodating: (i) the first axial offset A1 between the coupling 80 and the center hub 60; and, (ii) the first radial offset R1 between the coupling 80 and the center hub 60. It could also be possible to modify the first and second hub tab perimeter surfaces 89A, 89B and the respective first and second slot perimeter surfaces 69A, 69B to accommodate one of either the first axial offset A1 or the first radial offset R1.

A second end 82 of the coupling 80 is non-rotatably connected to the drive end 43 of the inner camshaft 44, accommodating a second radial offset R2 and a second axial offset A2. The second end 82 of the coupling 80 includes a third camshaft tab 84A and a fourth camshaft tab 84B that are received by a respective third slot 88A and a fourth slot 88B arranged at the drive end 43 of the inner camshaft 44. The third and fourth camshaft tabs 84A, 84B and the third and fourth slots 88A, 88B define a pathway for the second radial offset R2 and a pathway for the second axial offset A2. The third camshaft tab 84A has a third camshaft perimeter surface 93A and the fourth camshaft tab 84B has a fourth camshaft perimeter surface 93B; the third slot 88A has a third slot perimeter surface 73A, and the fourth slot 88B has a fourth slot perimeter surface 73B. Therefore, it could be stated that the third and fourth camshaft tab perimeter surfaces 93A, 93B together with the respective third and fourth slot perimeter surfaces 73A, 73B define a pathway for the second radial offset R2 and a pathway for the second axial offset A2. The third and fourth camshaft tabs 84A, 84B and the respective third and fourth slots 88A, 88B provide a non-rotatable connection between the coupling 80 and inner camshaft 44, while accommodating: (i) the second axial offset A2 between the coupling 80 and inner camshaft 44; and, (ii) the second radial offset R2 between the coupling 80 and the inner camshaft 44. It could also be possible to modify the third and fourth camshaft tab perimeter surfaces 93A, 93B and the respective third and fourth slot perimeter surfaces 73A, 73B to accommodate one of either the second axial offset A2 or the second radial offset R2.

Figure 9A:
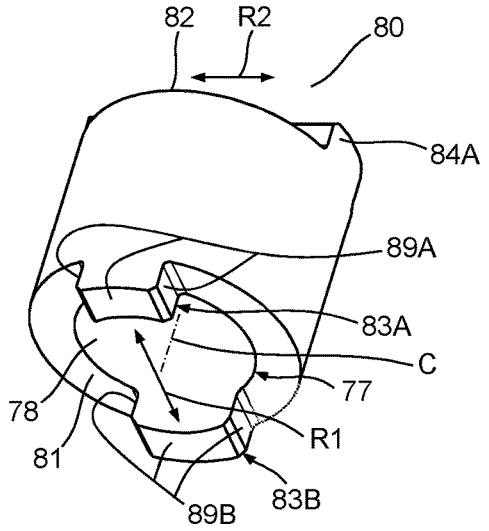
FIG. 9A is a perspective view showing a first end of the coupling of FIG. 3.
Figure 9B:
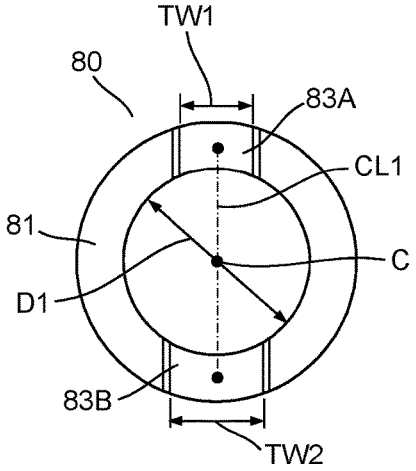
FIG. 9B is a front view of the coupling shown in FIG. 3.
Figure 9C:
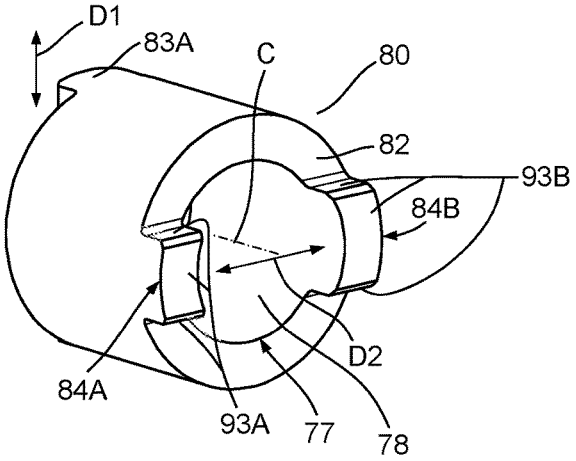
FIG. 9C is a perspective view showing a second end of the coupling of FIG. 3.
Figure 10A:
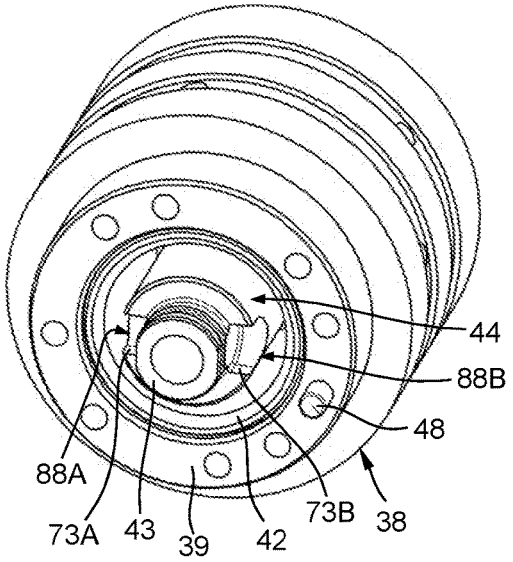
FIG. 10A is a perspective view of the concentric camshaft assembly of FIG. 1.
Figure 10B:
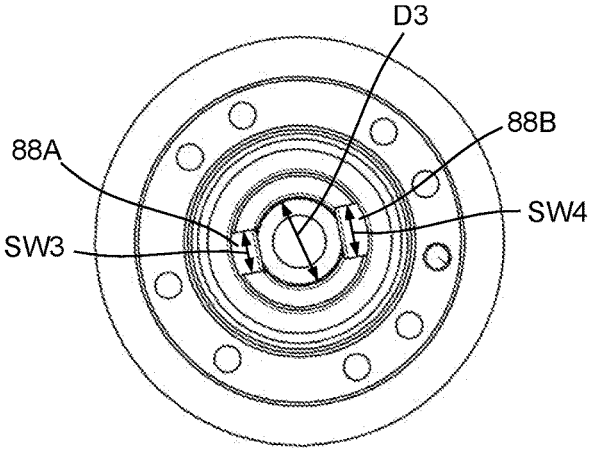
FIG. 10B is a front view of the concentric camshaft assembly of FIG. 10A.

As shown in FIGS. 9A through 9C, the first and second hub tabs 83A, 83B are opposed or 180 degrees apart; a first line CL1 that connects the center of the first hub tab 83A to the center of the second hub tab 83B intersects a center axis C of the coupling 80. For tolerance and manufacturability purposes, it can be stated that the center of the first hub tab 83A is located within a range of 175 to 185 degrees from the center of the second hub tab 83B. Additionally, the third and fourth camshaft tabs 84A, 84B are also opposed or 180 degrees apart; a second line CL2 that connects the center of the third camshaft tab 84A to the center of the fourth camshaft tab 84B intersects a center axis C of the coupling 80. For tolerance and manufacturability purposes, it can be stated that the center of the third camshaft tab 84A is located within a range of 175 to 185 degrees from the center of the fourth camshaft tab 84B. The first line CL1 is perpendicular to the second line CL2, and, similarly, the first radial offset R1 is perpendicular to the second radial offset R2. Various arrangements and numbers of hub tabs and camshaft tabs on the coupling 80 are possible to fulfill the purpose of non-rotatably connecting the first camshaft phaser 20 to the concentric camshaft assembly 40.

"Poka-yoke" is a common term that means "mistake-proofing" or "inadvertent error prevention." Multiple orientation possibilities for assembly of the coupling 80 within the camshaft phaser arrangement 10 should be avoided, as a specific orientation of the first rotor 24 relative to the inner camshaft 44 is vital to the function of the internal combustion engine. To ensure proper rotational orientation (or proper timing) of the first rotor 24 of the first camshaft phaser 20 to the inner camshaft 44 of the concentric camshaft assembly 40, the first end 81 of the coupling 80 and the coupling end 62 of the center hub cooperate to form a first rotational poka-yoke, and the second end 82 of the coupling 80 and the drive end 43 of the inner camshaft 44 cooperate to form a second rotational poka-yoke. An additional rotational poka-yoke could also be applied between the center hub 60 and the first rotor 24, possibly between the phaser end 61 of the center hub 60 and the first rotor face 53 of the first rotor 24.

With reference to FIGS. 7A and 7B together with FIGS. 9A and 9B, the first rotational poka-yoke can be described as follows. The first and second hub tabs 83A, 83B have different respective first and second tab widths TW1, TW2 that are received by respective complementary first and second slots 64A, 64B having respective different first and second slot widths SW1, SW2. The term "complementary" is used to describe forms of the first and second slots 64A, 64B that are compatible with or harmonize with the forms of the first and second hub tabs 83A, 83B. In the shown example embodiment, the first slot width SW1 is smaller than the second slot width SW2, with the first slot width SW1 too small to receive the second hub tab 83B formed with the larger second tab width TW2. Therefore, the first and second slots 64A, 64B of the center hub 60 can only receive the first end 81 of the coupling 80 in one rotational orientation. Furthermore, the forms of the first and second hub tabs 83A, 83B and the complementary forms of the first and second slots 64A, 64B accommodate a sliding radial fit and a sliding axial fit to facilitate the respective first radial offset R1 and the first axial offset A1. In summary, the coupling end 62 of the center hub 60 and the first end 81 of the coupling 80 can cooperate to accommodate: (i) the first radial offset R1; (ii) the first axial offset A1; and, (iii) the first poka-yoke.

Figure 9D:
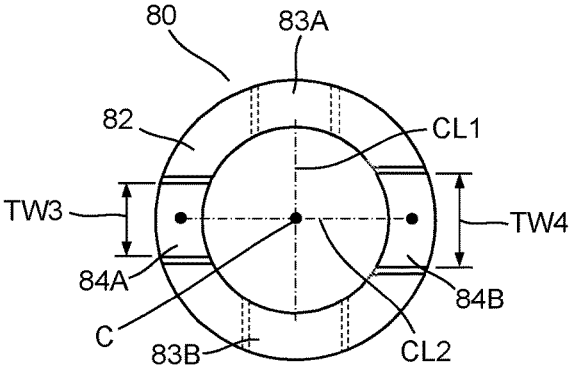
FIG. 9D is a rear view of the coupling shown in FIG. 3.

With reference to FIGS. 9C and 9D together with FIGS. 10A and 10B, the second rotational poka-yoke can be described as follows. The third and fourth camshaft tabs 84A, 84B of the coupling 80 have different respective third and fourth tab widths TW3, TW4 that are received by respective complementary third and fourth slots 88A, 88B of the inner camshaft 44 having respective different third and fourth slot widths SW3, SW4. In the shown example embodiment, the third slot width SW3 is smaller than the fourth slot width SW4, with the third slot width SW3 too small to receive the fourth camshaft tab 84B formed with the larger fourth tab width TW4. Therefore, the third and fourth slots 88A, 88B of the inner camshaft 44 can only receive the second end 82 of the coupling 80 in one rotational orientation. Furthermore, the forms of the third and fourth camshaft tabs 84A, 84B and the complementary forms of the third and fourth slots 88A, 88B accommodate a sliding radial fit and a sliding axial fit to facilitate the respective second radial offset R2 and the second axial offset A2. In summary, the drive end 43 of the inner camshaft 44 and the second end 82 of the coupling 80 can cooperate to accommodate: (i) the second radial offset R2; (ii) the second axial offset A2; and, (iii) the second poka-yoke.

In addition to the previously described features of the coupling 80, an additional attribute includes facilitation of flow of hydraulic fluid F from a first fluid cavity 76 of the inner camshaft 44 to the valve body 17 of the first hydraulic fluid control valve 14, by way of a second fluid cavity 79 of the center hub 60. For the example embodiment shown, the hydraulic fluid F delivered to the valve body 17 serves as a pressurized fluid supply to the first hydraulic fluid control valve 14, however, any form of hydraulic fluid transfer by the coupling 80 is possible. The transfer of hydraulic fluid F from the inner camshaft 44 to the first hydraulic fluid control valve 14 is facilitated by a through-aperture 77 of the coupling 80 that fluidly connects the first fluid cavity 76 of the inner camshaft 44 to the second fluid cavity of the center hub 60. To prevent leakage of the hydraulic fluid F from the through-aperture 77, a first compliant radial seal 67A is arranged to seal the coupling 80 to the coupling end 62 of the center hub 60, and a second compliant radial seal 67B is arranged to seal the coupling 80 to the inner camshaft 44.

The first compliant radial seal 67A is arranged within a first groove 66A formed on a nose 65 of the center hub 60, and the second compliant radial seal 67B is arranged within a second groove 66B formed on the drive end 43 of the inner camshaft 44. Both the first and second compliant radial seals 67A, 67B seal against a sealing surface 78 of the through-aperture 77 of the coupling 80. A first diameter D1 of the through-aperture 77 is larger than a second diameter D2 of the nose 65 of the center hub to accommodate radial offset and/or axial offset between the center hub 60 and the coupling 80. Likewise, the first diameter D1 of the through-aperture 77 is also larger than a third diameter D3 of a drive end 43 of the inner camshaft 44 to accommodate radial offset and/or axial offset between the coupling 80 and the inner camshaft 44.

The first compliant radial seal 67A is configured to maintain engagement with both the center hub 60 and the coupling 80 while the coupling 80 accommodates radial offset and/or axial offset of the coupling 80 relative to the center hub 60; stated otherwise, the first compliant radial seal 67A is configured to maintain engagement with both the center hub 60 and the coupling 80 while the coupling 80 accommodates radial offset and/or axial offset of the first rotor 24 of the first camshaft phaser 20 relative to the inner camshaft 44 of the concentric camshaft assembly 40. Furthermore, since the second rotor 34 of the second camshaft phaser 30 is non-rotatably connected to the concentric camshaft assembly 40, it could also be stated that the first compliant radial seal 67A is configured to maintain engagement with both the center hub 60 and the coupling 80 while the coupling 80 accommodates radial offset and/or axial offset between the first camshaft phaser 20 and the second camshaft phaser 30.

The second compliant radial seal 67B is configured to maintain engagement with both the inner camshaft 44 and the coupling 80 while the coupling 80 accommodates radial offset and/or axial offset of the coupling 80 relative to the inner camshaft 44; stated otherwise, the second compliant radial seal 67B is configured to maintain engagement with both the inner camshaft 44 and the coupling 80 while the coupling accommodates radial offset and/or axial offset of the first rotor 24 of the first camshaft phaser 20 relative to the inner camshaft 44 of the concentric camshaft assembly 40. Furthermore, since the second rotor 34 of the second camshaft phaser 30 is non-rotatably connected to the concentric camshaft assembly 40, it could also be stated that the second compliant radial seal 67B is configured to maintain engagement with both the inner camshaft 44 and the coupling 80 while the coupling 80 accommodates radial offset and/or axial offset between the first camshaft phaser 20 and the second camshaft phaser 30.

Discussion of the non-rotatable connections between components of the camshaft phaser arrangement 10 and the concentric camshaft assembly 40 can provide insight into the challenges of assembling these components within an internal combustion engine. Manufacturing tolerances of the individual components of the camshaft phaser arrangement 10 and concentric camshaft assembly 40 together with manufacturing tolerances of an engine cylinder head that receives the concentric camshaft assembly 40 can necessitate a compliant non-rotatable connection such as that provided by the previously described coupling 80. The second rotor 34 of the second camshaft phaser 30 is axially clamped and non-rotatably connected to the outer camshaft 42 by the cam bolt 70; the second stator 35 that circumferentially surrounds the second rotor 34 is rigidly and non-rotatably connected to the first stator 25 via the first fasteners 19. Thus, the first and second stators 25, 35 move axially and radially together as one unit, separately and relative to the second rotor 34 that is rigidly connected to the outer camshaft 42. Given that the first rotor 24 is non-rotatably connected with the inner camshaft 44, and the significant tolerance stack-up of the many components that reside between the first rotor 24 and the inner camshaft 44, the coupling 80 and its provided axial and radial compliant non-rotatable connections with the second camshaft phaser 30 and the inner camshaft 44, offers a viable solution. In addition to providing a manufacturing solution, the coupling 80 also offers a functional solution during use of the IC engine. For example, dynamic axial and radial valve train forces that act on the inner camshaft 44 are likely different than dynamic axial and radial valve train forces that act on the outer camshaft 42, which can translate to unequal axial and radial movements of the inner camshaft 44 relative to the outer camshaft 42. In addition, a power transmission force that is applied to the drive wheel 45 of the second camshaft phaser 30, is likely to further influence the relative movement of components of the system. For these conditions, the coupling 80 provides an axially and radially compliant non-rotatable connection between the inner camshaft 44 and the first rotor 24, while permitting a non-compliant non-rotatable connection between the second rotor 34 and outer camshaft 42.

Figure 11A:
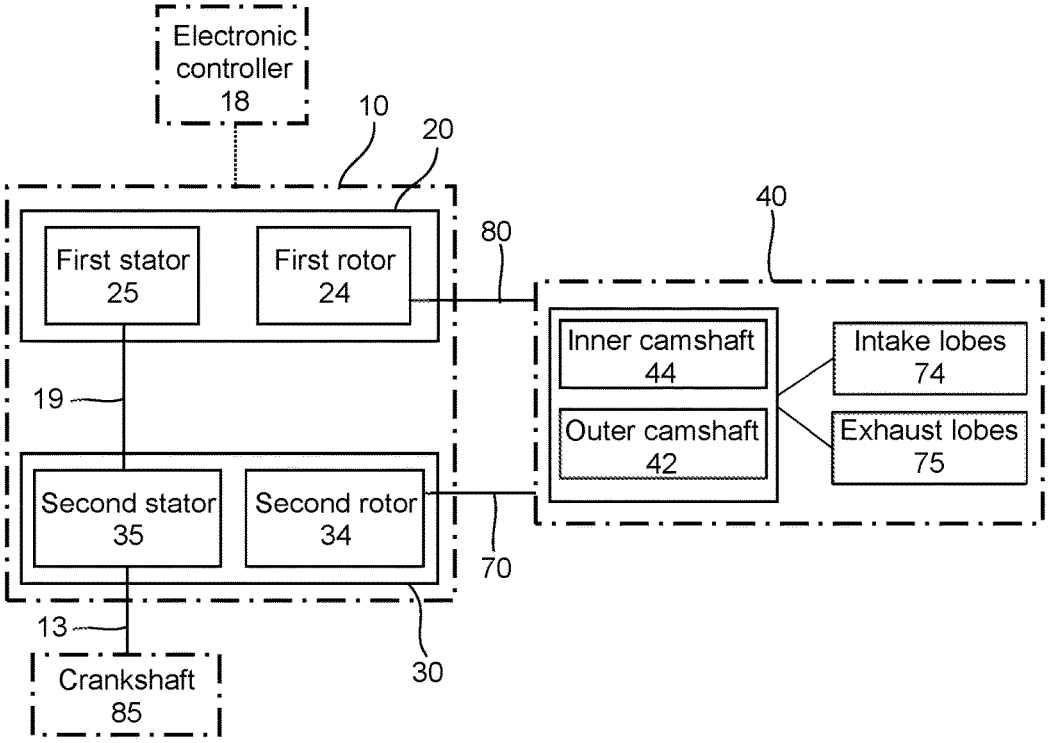
FIG. 11A is a schematic diagram of the camshaft phaser arrangement of FIG. 1, depicting a flexible location of intake and exhaust camshaft lobes within the concentric camshaft assembly.

FIG. 11A is a schematic diagram that captures the previously described camshaft phaser arrangement 10, while also depicting its connection flexibility with the concentric camshaft assembly 40; it would be possible to configure the first camshaft phaser 20 such that it phases the outer camshaft 42 and the second camshaft phaser 30 such that it phases the inner camshaft 44. Within FIG. 11A, non-rotatable connections are denoted by solid connector lines between components, with the connector lines labeled with element numbers of previously described components. As shown, the first rotor 24 of the first camshaft phaser 20 is non-rotatably connected to either the inner camshaft 44 or the outer camshaft 42 of the concentric camshaft assembly 40 by the coupling 80; the first stator 25 of the first camshaft phaser 20 is non-rotatably connected to the second stator 35 of the second camshaft phaser 30 by first fasteners 19; and, the second rotor 34 of the second camshaft phaser 30 is non-rotatably connected by the cam bolt 70 to either of the inner or outer camshafts 44, 42.

The camshaft phaser arrangement 10 for the concentric camshaft assembly 40 provides independent phasing of the inner camshaft 44 relative to the outer camshaft 42. The camshaft phaser arrangement 10 can be controlled by the electronic controller 18; the electronic controller 18 can possibly be an electronic control unit (ECU) that controls an IC engine. The concentric camshaft assembly 40 includes intake lobes 74 and exhaust lobes 75, each of which can be arranged on either the inner camshaft 44 or the outer camshaft 42. In some engine design instances, it may prove advantageous to have the outer camshaft 42 configured with the exhaust lobes 75 and the inner camshaft 44 to be configured with the intake lobes 74, however, this arrangement could also be reversed.

Figure 11B:
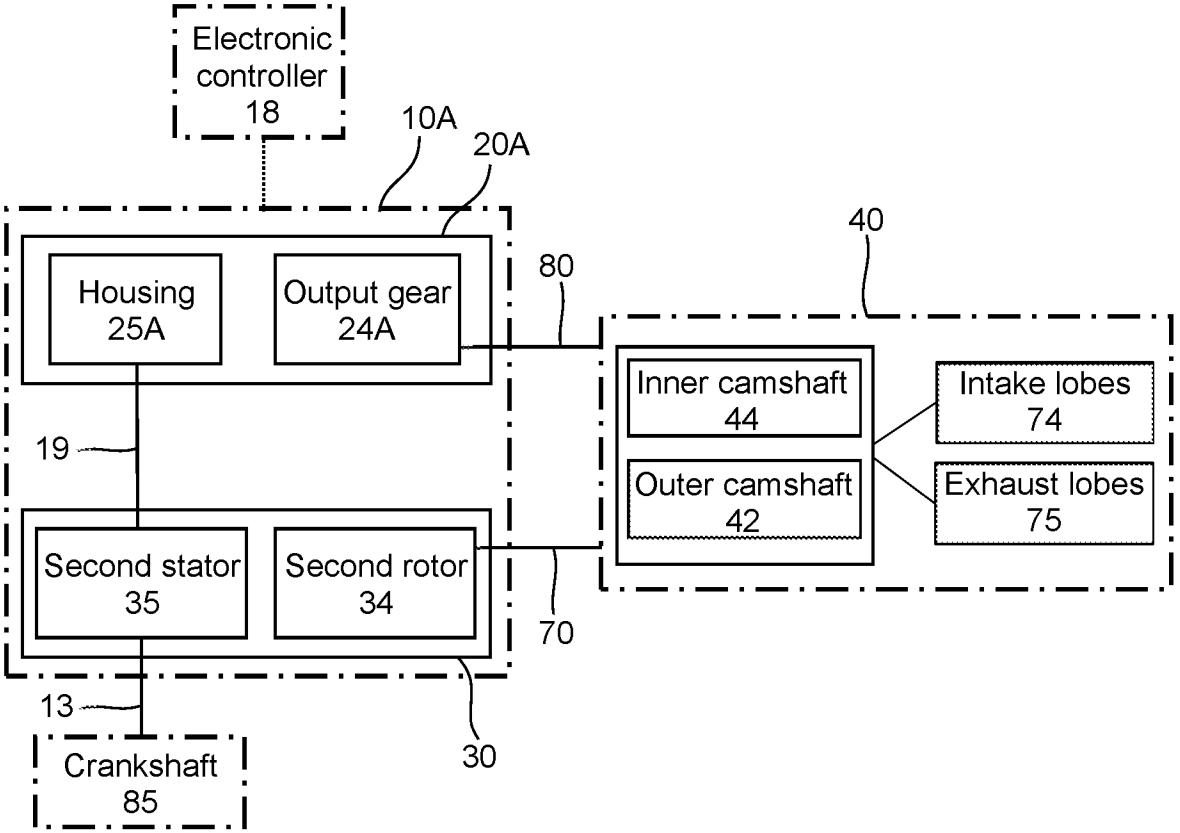
FIG. 11B is a schematic diagram of an example embodiment of a camshaft phaser arrangement with a first electric camshaft phaser and a second hydraulically actuated camshaft phaser.

The first camshaft phaser 20 and second camshaft phaser 30 can be actuated hydraulically with hydraulic fluid such as engine oil, electrically with an electric motor, or by any other actuation means. The camshaft phaser arrangement 10 in FIGS. 1 through 11A show a first camshaft phaser 20 and a second camshaft phaser that are both hydraulically actuated. Referring to FIG. 11B, it could also be possible to have a camshaft phaser arrangement 10A that includes an electrically actuated first camshaft phaser 20A together with the hydraulically actuated second camshaft phaser 30. Furthermore, it could also be possible to have two electrically actuated camshaft phasers. In summary, the first and second camshaft phasers can include at least one of a hydraulic camshaft phaser or an electric camshaft phaser.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser arrangement configured for a concentric camshaft assembly having inner and outer camshafts, the camshaft phaser arrangement comprising:

a first camshaft phaser configured to be connected to one of the inner or outer camshafts, the first camshaft phaser having a center hub;

a second camshaft phaser configured to be connected to a remaining one of the inner or outer camshafts via a cam fastener, the second camshaft phaser axially adjacent to the first camshaft phaser;

a coupling disposed at least partially within the cam fastener, the coupling having a first end non-rotatably connected to a coupling end of the center hub and a second end configured to be non-rotatably connected to the one of the inner or outer camshafts; and, at least one first fastener connecting the first camshaft phaser to the second camshaft phaser; and, the coupling configured to accommodate at least one of a radial offset or an axial offset between the first camshaft phaser and the concentric camshaft assembly.

2. The camshaft phaser arrangement of claim 1, wherein the coupling is configured to accommodate a first radial offset and a second radial offset between the first camshaft phaser and the concentric camshaft assembly, the first radial offset is perpendicular to the second radial offset.

3. The camshaft phaser arrangement of claim 1, wherein the coupling includes a through-aperture, the through-aperture configured to fluidly connect the concentric camshaft assembly to the first camshaft phaser so that hydraulic fluid can flow from the concentric camshaft assembly to the first camshaft phaser via the through-aperture.

4. The camshaft phaser arrangement of claim 3, further comprising:

a first compliant radial seal arranged to seal the center hub to the first end of the coupling; and, a second compliant radial seal arranged to seal the second end of the coupling to the one of the inner or outer camshafts; and, the first compliant radial seal configured to maintain engagement with both the center hub and the coupling while the coupling accommodates the at least one of the radial offset or the axial offset between the first camshaft phaser and the concentric camshaft assembly; and, the second compliant radial seal configured to maintain engagement with both the coupling and the one of the inner or outer camshafts while the coupling accommodates the at least one of the radial offset or the axial offset between the first camshaft phaser and the concentric camshaft assembly.

5. The camshaft phaser arrangement of claim 1, wherein the first end of the coupling and the coupling end of the center hub cooperate to form a first rotational poka-yoke and the second end of the coupling is configured to form a second rotational poka-yoke with the one of the inner or outer camshaft.

6. The camshaft phaser arrangement of claim 1, wherein:

the radial offset comprises a first radial offset and a second radial offset, and the axial offset comprises a first axial offset and a second axial offset;

the first end of the coupling includes at least one hub tab configured to be received by the center hub, the at least one hub tab and the center hub defining a pathway for at least one of the first radial offset or the first axial offset; and, the second end of the coupling includes at least one camshaft tab configured to be received by the one of the inner or outer camshafts, the at least one camshaft tab and the one of the inner or outer camshafts defining a pathway for at least one of the second radial offset or the second axial offset.

7. The camshaft phaser arrangement of claim 6, wherein the at least one hub tab comprises a first tab and a second tab and the at least one camshaft tab comprises a third tab and a fourth tab.

8. The camshaft phaser arrangement of claim 7, wherein the first tab has a first width that is different than a second width of the second tab, and the third tab has a third width that is different than a fourth width of the fourth tab.

9. The camshaft phaser arrangement of claim 7, wherein a center of the first tab is located within a range of 175 to 185 degrees from a center of the second tab, and a center of the third tab is located within a range of 175 to 185 degrees from a center of the fourth tab.

10. The camshaft phaser arrangement of claim 9, wherein a first line connects the center of the first tab to the center of the second tab and a second line connects the center of the third tab to the center of the fourth tab, the first line is perpendicular to the second line.

11. The camshaft phaser arrangement of claim 1, wherein:

the radial offset comprises a first radial offset and a second radial offset, and the axial offset comprises a first axial offset and a second axial offset; and, the coupling end of the center hub and the first end of the coupling cooperate to accommodate at least one of: i) the first axial offset between the first camshaft phaser and the concentric camshaft assembly; or, ii) the first radial offset between the first camshaft phaser and the concentric camshaft assembly.

12. The camshaft phaser arrangement of claim 11, wherein the second end of the coupling is configured to cooperate with the one of the inner or outer camshafts to accommodate at least one of: i) the second axial offset between the first camshaft phaser and the concentric camshaft assembly; or, ii) the second radial offset between the first camshaft phaser and the concentric camshaft assembly.

13. The camshaft phaser arrangement of claim 1, wherein the at least one first fastener connects a first stator of the first camshaft phaser to a second stator of the second camshaft phaser.

14. The camshaft phaser arrangement of claim 13, wherein the at least one first fastener connects the first stator of the first camshaft phaser to a second outer cover of the second camshaft phaser.

15. The camshaft phaser arrangement of claim 14, wherein at least one support boss extends axially from the second outer cover, the at least one support boss configured to receive the at least one first fastener.

16. The camshaft phaser arrangement of claim 1, further comprising a hydraulic fluid control valve arranged within the first camshaft phaser, the first camshaft phaser arranged axially outward of the second camshaft phaser.

17. A camshaft phaser arrangement configured for a concentric camshaft assembly having inner and outer camshafts, the camshaft phaser arrangement comprising:

a first hydraulic camshaft phaser configured to be connected to the inner camshaft, the first camshaft phaser having a center hub;

a second hydraulic camshaft phaser configured to be connected to the outer camshaft via a cam fastener;

a coupling having a first end non-rotatably connected to the center hub and a second end configured to be non-rotatably connected to the inner camshaft, the second end disposed within a through-aperture of the cam fastener; and, at least one fastener connecting a first stator of the first camshaft phaser to a second stator of the second camshaft phaser; and, the coupling configured to accommodate at least one of a radial offset or an axial offset between a first rotor of the first camshaft phaser and the inner camshaft.

18. The camshaft phaser arrangement of claim 17, wherein the center hub is configured to be attached to the first camshaft phaser via a threaded interface with a hydraulic fluid control valve.

19. A camshaft phaser arrangement configured for a concentric camshaft assembly having inner and outer camshafts, the camshaft phaser arrangement comprising:

a first camshaft phaser configured to be connected to one of the inner or outer camshafts, the first camshaft phaser having a center hub;

a second camshaft phaser configured to be connected to a remaining one of the inner or outer camshafts via a cam fastener, the second camshaft phaser axially adjacent to the first camshaft phaser;

a coupling having a first end non-rotatably connected to a coupling end of the center hub and a second end configured to be non-rotatably connected to the one of the inner or outer camshafts; and, at least one first fastener connecting the first camshaft phaser to the second camshaft phaser; and, the coupling configured to accommodate at least one of a radial offset or an axial offset between the first and second camshaft phasers; and, the center hub extending within a through-aperture of the cam fastener.

20. The camshaft phaser arrangement of claim 19, wherein the second end of the coupling extends within the through-aperture of the cam fastener, and the through-aperture is configured to receive the one of the inner or outer camshafts.

* * * * *